US009826867B2

(12) United States Patent
Krause et al.

(10) Patent No.: US 9,826,867 B2
(45) Date of Patent: Nov. 28, 2017

(54) DUAL COMPARTMENT MOUNTABLE SANITATION STATION

(71) Applicants: Jeremy Krause, Stewartville, MN (US); Michelle Krause, Stewartville, MN (US)

(72) Inventors: Jeremy Krause, Stewartville, MN (US); Michelle Krause, Stewartville, MN (US)

( * ) Notice: Subject to any disclaimer, the term of this patent is extended or adjusted under 35 U.S.C. 154(b) by 0 days.

(21) Appl. No.: 14/530,166

(22) Filed: Oct. 31, 2014

(65) Prior Publication Data

US 2017/0112337 A1 Apr. 27, 2017

(51) Int. Cl.

| | |
|---|---|
| ***E03D 9/02*** | (2006.01) |
| ***A47K 17/00*** | (2006.01) |
| ***B65D 43/16*** | (2006.01) |
| ***B65D 43/02*** | (2006.01) |
| ***B65D 55/02*** | (2006.01) |
| ***B65D 21/02*** | (2006.01) |
| ***B65D 83/08*** | (2006.01) |
| ***B65D 43/22*** | (2006.01) |

(52) U.S. Cl.

CPC ..... *A47K 17/00* (2013.01); *B65D 21/0209* (2013.01); *B65D 43/02* (2013.01); *B65D 43/16* (2013.01); *B65D 43/22* (2013.01); *B65D 55/02* (2013.01); *B65D 83/0805* (2013.01); *A47K 2201/02* (2013.01)

(58) Field of Classification Search

CPC ..... E03D 2009/024
USPC ..... 4/222–233
See application file for complete search history.

(56) References Cited

U.S. PATENT DOCUMENTS 2,029,460 A * 2/1936 Brady ..... G07F 13/10 126/374.1
2,340,561 A * 2/1944 Renfro ..... A47F 1/08 312/42
2,695,117 A * 11/1954 Daniels ..... B67D 1/0858 141/392
3,233,784 A * 2/1966 Gordon ..... B65D 35/285 222/102
4,706,845 A * 11/1987 Schnurer ..... A47F 1/08 221/102
4,895,418 A * 1/1990 Medellin ..... B67D 1/06 108/38
5,213,254 A * 5/1993 Regis ..... B65D 5/48042 206/425

(Continued)

*Primary Examiner* — Lori Baker
(74) *Attorney, Agent, or Firm* — The Keys Law Firm PLLC

(57) ABSTRACT

A dual compartment mountable sanitation station for mounting in a public bathroom stall is shown as a wall mountable station housing with an upper compartment portion and a lower compartment portion, with the upper compartment portion and the lower compartment portion arranged in a stacked orientation, with each providing a discrete, lockable storage enclosure. In the preferred embodiment, the upper compartment portion includes a removable top and is used to house a canister of flushable disinfectant wipes, with the canister held so that wipes can be accessed and removed for use on surfaces in the public bathroom stall in which the dual compartment mountable sanitation station is mounted, while the lower compartment portion includes a hingedly attached front door and is used to house a bottom dispensing hand sanitizer dispenser.

20 Claims, 3 Drawing Sheets

(56) References Cited

U.S. PATENT DOCUMENTS 5,269,456 A * 12/1993 Regis ..... B65D 5/48042 206/425
5,758,818 A * 6/1998 Ewing, Jr. ..... B65D 5/5495 229/120.011
5,884,499 A * 3/1999 Samborn ..... A47F 1/08 312/35
5,887,818 A * 3/1999 Kelley ..... A47K 10/22 242/559.3
7,870,753 B2 * 1/2011 Marcy, V ..... F25D 23/028 312/405
8,072,738 B2 * 12/2011 Kendall ..... F25D 23/028 248/442.2
2003/0188377 A1 * 10/2003 Contadini ..... E03D 9/007 4/222
2004/0026530 A1 * 2/2004 Callueng ..... A61L 2/22 239/69
2006/0283873 A1 * 12/2006 Bostic ..... A47K 10/32 221/33
2006/0289558 A1 * 12/2006 Parker ..... A47K 10/3818 221/97
2009/0223991 A1 * 9/2009 Lorenzati ..... A47K 10/421 221/34
2009/0223992 A1 * 9/2009 Lorenzati ..... A47K 10/421 221/34
2009/0223993 A1 * 9/2009 Lorenzati ..... A47K 10/42 221/35
2010/0163569 A1 * 7/2010 Parker ..... A47K 10/3818 221/1
2013/0043267 A1 * 2/2013 Lim ..... A47K 10/20 221/45
2014/0014675 A1 * 1/2014 Ingvarsson ..... A47K 5/06 221/155
2015/0083743 A1 * 3/2015 D'Angelo ..... A47K 10/38 221/45
2015/0136623 A1 * 5/2015 Gooden ..... A45C 5/005 206/233
2017/0027393 A1 * 2/2017 Barnes ..... A47K 10/36

* cited by examiner

DUAL COMPARTMENT MOUNTABLE SANITATION STATION

DETAILED DESCRIPTION OF THE INVENTION

Figure 1:
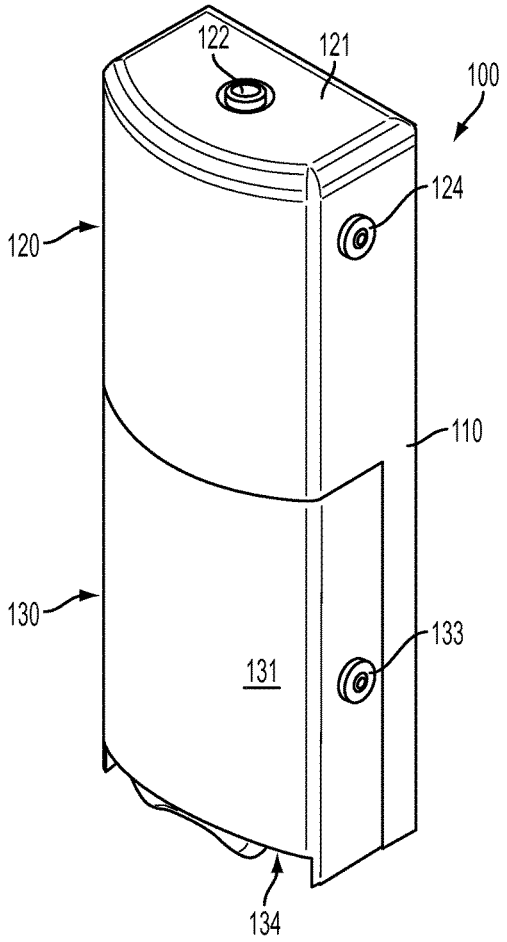
FIG. 1 is a left side perspective view of a dual compartment mountable sanitation station built in accordance with the present invention.
Figure 2:
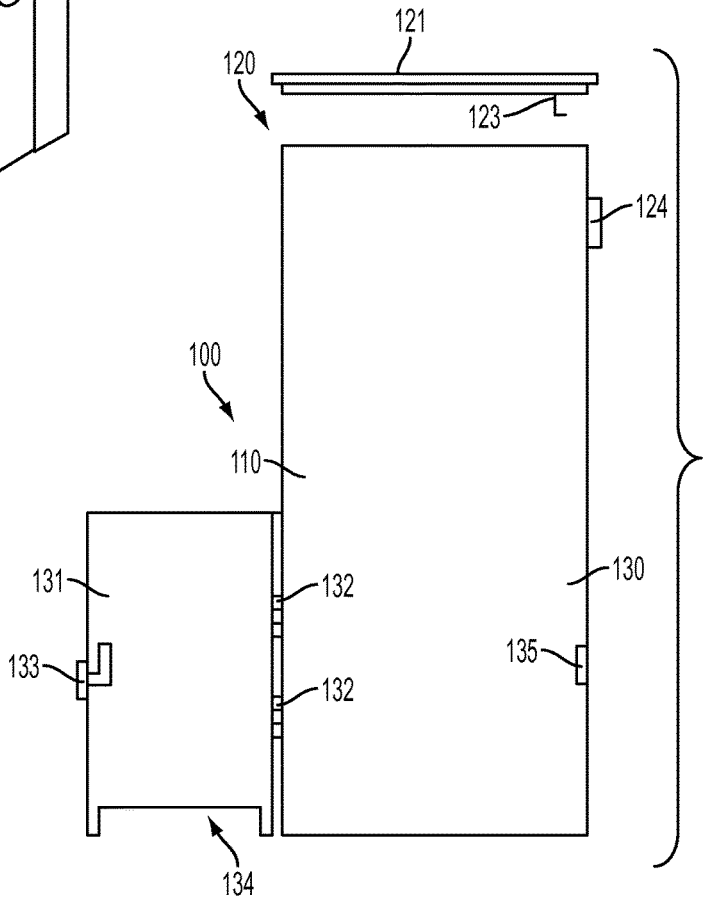
FIG. 2 is an exploded front elevational view of a dual compartment mountable sanitation station built in accordance with the present invention.
Figure 3:
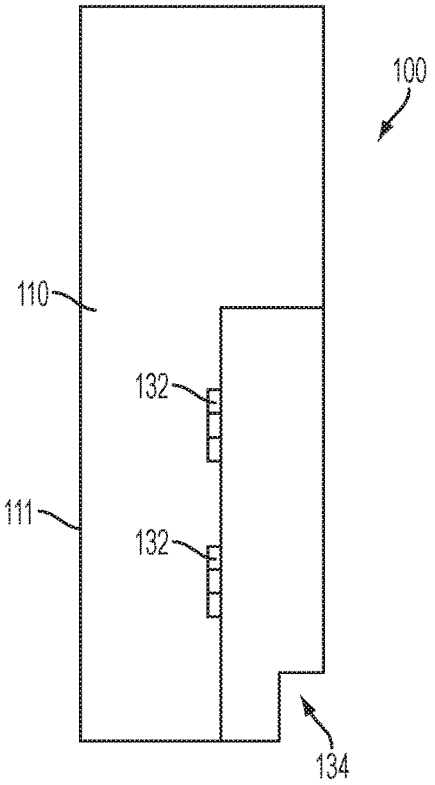
FIG. 3 is a right side elevational view of a dual compartment mountable sanitation station built in accordance with the present invention.
Figure 4:
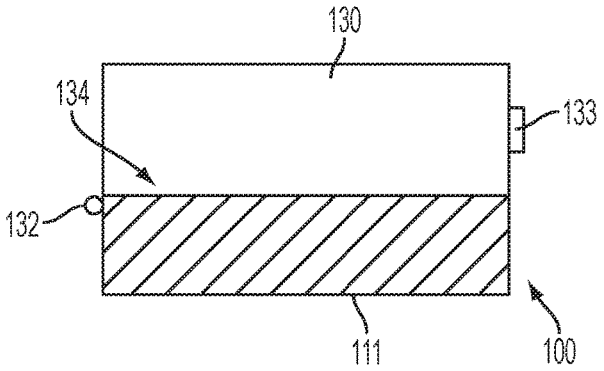
FIG. 4 is a bottom plan view of a dual compartment mountable sanitation station built in accordance with the present invention.
Figure 5A:
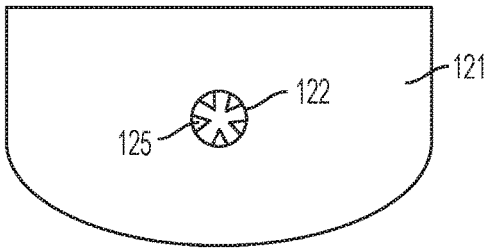
FIG. 5A is a top plan view of the removable top piece of a dual compartment mountable sanitation station built in accordance with the present invention.
Figure 5B:
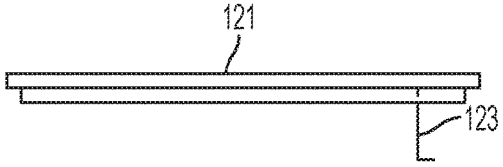
FIG. 5B is a front elevational view of the removable top piece of a dual compartment mountable sanitation station built in accordance with the present invention.

Referring now to the drawings and in particular FIGS. 1, 2, 3, 4, and 5, a dual compartment mountable sanitation station 100 for mounting in a public bathroom stall is shown as a wall mountable station housing 110 with an upper compartment portion 120 and a lower compartment portion 130. It is contemplated that the station housing 110 is wall mountable through conventional mounting mechanism. Accordingly, in one embodiment, the back surface 111 of the station housing 110 includes a plurality of mounting apertures (not shown). In other embodiments, the back surface 111 may be mounted to a wall through an adhesive or with a screw(s) or other fastener(s).

The upper compartment portion 120 and lower compartment portion 130 are arranged in a stacked orientation, with each providing a discrete, lockable storage enclosure. In the preferred embodiment, the upper compartment portion 120 is used to house a canister of flushable disinfectant wipes, with the canister held so that wipes can be accessed and removed for use on surfaces in the public bathroom stall in which the dual compartment mountable sanitation station 100 is mounted, and the lower compartment portion is used to house a bottom dispensing hand sanitizer dispenser.

The upper compartment portion 120 includes a removable top 121 that, when in place on the upper compartment 120, forms the enclosure that defines the upper compartment portion 120. The removable top 121 has a dispensing aperture 122 through which wipes in the upper compartment portion 120 can be pulled and a latching member 123 that allows the removable top 121 to be locked in place on the upper compartment portion 120.

Accessing the enclosed area of the upper compartment portion 120, beyond merely pulling a wipe through the dispensing aperture 122, is accomplished by removing the removable top 121 from the upper compartment portion 120, thereby revealing its interior. An upper cam lock 124 is integrated in the side wall of the upper compartment portion 120 and positioned so that when it is actuated, it engages the latching member 123 of the removable top 121 when the removable top 121 is in place on the upper compartment portion 120, forming an interlock that locks it in place on the upper compartment portion 120. As it is contemplated that the upper compartment portion 120 will be employed for dispensing flushable disinfectant wipes from a canister housed therein, the upper cam lock 124 and the latching member 123 provide an upper means for selectively locking the enclosure formed by the removable top 121 on the upper compartment portion 120 so access to such a canister can be restricted.

Accordingly, when the removable top 121 is in place on the upper compartment portion 120 and the upper cam lock 124 is engaged with the latching member 123 to lock the removable top 121 thereon, access to the enclosure defining the upper compartment portion is restricted and such a canister holding disinfectant wipes (or other wipes) is secured inside the upper compartment portion 120. Conversely, when access to such a wipes canister is desired, generally to replenish or change it, the upper cam lock 124 can be disengaged from the latching member 123 to allow the removable top 121 to be lifted off the upper compartment portion 120, thereby opening the enclosure defining the upper compartment portion 120.

The lower compartment portion 130 includes a front door 131 that is hingedly attached to one side of the lower compartment portion 130 by a pair of hinges 132. Through the hinged attachment, the front door 131 can be swung between a closed position illustrated in FIG. 1, and an open position illustrated in FIG. 2. The front door 131 in the closed position on the lower compartment portion 130 forms the enclosure that defines the lower compartment portion 130.

The front door 131 additionally includes an integrated lower cam lock 133 and a recessed area 134. The lower cam lock 133 that is positioned so that when it is actuated, it engages a latching lip 135 integrated in the internal wall of the lower compartment portion 130 to form an interlock that locks the front door in the closed position against the lower compartment portion 130. As such, the lower cam lock 133 and the latching lip 135 provide a lower means for selectively locking the enclosure formed by the front door 131 on the lower compartment portion 130.

As is contemplated that the lower compartment portion 130 will be employed to house a bottom dispensing fluid sanitizer dispenser apparatus, the recessed area 134 provides a structural indentation that ensures the dispensing actuator and dispensing nozzle of such a sanitizer dispenser apparatus is not obstructed by the body of the front door 131.

Securing such a sanitizer dispenser apparatus in the lower compartment portion 130 is accomplished by mounting the apparatus on the back internal wall of the lower compartment portion, placing the front door in the closed position, and actuating the lower cam lock 133 until it engages the latching lip 135. When the dispenser apparatus is secured in the enclosed area of the lower compartment portion 130 in accordance with the present invention, only its dispensing actuator and dispensing nozzle are visible and accessible through the recessed area 135.

When it is desired to access such a dispenser apparatus in the enclosed area of the lower compartment portion 130, beyond actuating a dispensing actuator and receiving a portion of sanitizer solution from the dispensing nozzle, the front door 131 is swung out of the closed position to reveal the interior of the lower compartment portion 130. Prior to moving the front door 131 out of the closed position, however, the lower cam lock 133 must be placed in a disengaged position relative to the latching lip 135 integrated in the internal wall of the lower compartment portion 130, ensuring the front door 131 is not locked in the closed position.

Figure 6:
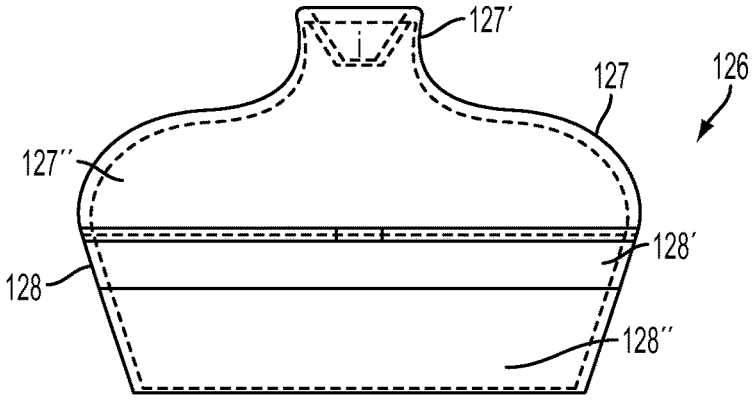
FIG. 6 is a side elevational view of the container lid of a dual compartment mountable sanitation station built in accordance with the present invention.
Figure 7:
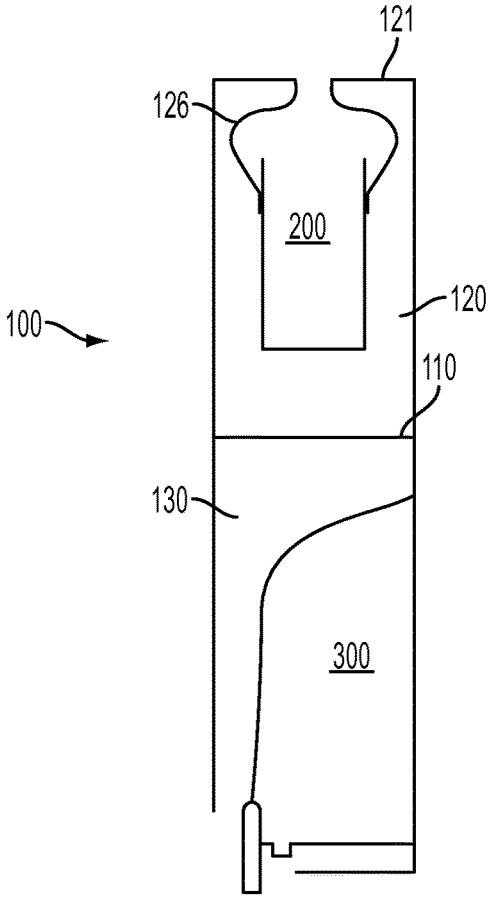
FIG. 7 is a side elevational view of a cross section of a dual compartment mountable sanitation station built in accordance with the present invention.

Referring now to FIGS. 1-7, it is contemplated that a conventional bottom dispensing sanitizer dispenser 300 will be mounted to an interior surface of the lower compartment portion 130, generally through an adhesive or other fasteners, and positioned so that its dispensing actuator and dispensing nozzle extend from the recessed area of the lower compartment portion. With respect to the upper compartment portion 120, from which flushable disinfectant wipes are dispensed from a top dispensing conventional wipes canister 200, the canister 200 must be suspended from the removable top 121 so that the wipes can be accessed and pulled through the dispensing aperture 122. Thus, the dispensing aperture 122 includes a plurality of deformable retaining flaps 125 that can securely hold the top area of a container access lid 126.

The container access lid 126 is defined by a rigid top section 127 and an attachment section 128. The top section 127 includes a dispensing tip 127' sized to fit through the dispensing aperture 122 and be held in place sufficient to resist inadvertent movement by the retaining flaps 125 and threaded bottom 127". The attachment section 128 includes a rigid threaded area 128' and an elastic holding area 128" with the threaded area 128' for attaching to the threaded bottom 127" and the holding area 128" for being stretched over the rim of an open top wipes canister 200 such that the rim of canister 200 securely held sufficient to resist inadvertently sliding out of the holding area 128".

In use, a canister is positioned in the upper compartment section 120 by removing the removable lid 121, attaching the attachment section 128 to the rim of the canister 200, securing the top section 127 to the attachment section 128, pushing the top of the dispensing tip 127' through the dispensing aperture 121 from the bottom, thereby engaging the retaining flaps 125, and replacing the dispensing top 121, with the container access lid 126 held in the dispensing aperture 122, onto the upper compartment section 120.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dual compartment mountable sanitation station for mounting in a public bathroom stall, comprising:

an upper compartment portion having a removable top, wherein said removable top includes a dispensing aperture;

a lower compartment portion having a movable wall movable between an open position and a closed position, wherein the upper compartment portion and lower compartment portion are arranged in a stacked orientation, the upper compartment portion is configured to hold a container of wipes, and the lower compartment is configured to have a bottom dispensing sanitizer dispensing apparatus mounted therein; and a container access lid configured to hold a wipes container and be suspended from the dispensing aperture, wherein the container access lid is defined by a rigid top section and an attachment section, wherein the top section includes a dispensing tip sized to fit through the dispensing aperture and threaded bottom and the attachment section includes a rigid threaded area and an elastic holding area, said threaded area for attaching to the threaded bottom and the holding area for being stretched over the rim of any wipes container such that the container is held sufficient to resist inadvertently sliding out of the holding area.

2. The dual compartment mountable sanitation station of claim 1, wherein the selectively movable wall is defined as a front door hingedly attached to the side of the lower compartment portion and which includes a recessed area through which any sanitizer dispensing apparatus mounted in the lower compartment may be accessed.

3. The dual compartment mountable sanitation station of claim 2, wherein said lower compartment portion includes an integrated latching lip and the front door includes a lower cam lock, said lower cam lock and latching positioned so that when the upper cam lock is actuated with the front door in the closed position, it engages the latching lip to form an interlock that locks the front door in the closed position against the lower compartment portion.

4. The dual compartment mountable sanitation station of claim 1, wherein the removable top includes a latching member and the upper compartment portion includes an integrated upper cam lock, said upper cam lock and latching member positioned such that when the upper cam lock is actuated with the removable top in place on the upper compartment portion, it engages the latching member and forms an interlock that locks the removable top in place on the upper compartment portion.

5. The dual compartment mountable sanitation station of claim 1, wherein the dispensing aperture includes at least one retaining flap adapted to hold the dispensing tip in place sufficient to resist inadvertent movement once it has been inserted through the dispensing aperture.

6. A dual compartment mountable sanitation station for mounting in a public bathroom stall, comprising:

an upper compartment portion having a removable top, wherein said removable top includes a dispensing aperture;

said removable top and the upper compartment portion including an upper means for selectively locking the enclosure formed by the removable top on the upper compartment portion so access to such a canister can be restricted;

a lower compartment portion having a front door hingedly attached to the side of the lower compartment portion such that it is movable between an open position and a closed position, wherein the upper compartment portion and lower compartment portion are arranged in a stacked orientation, the upper compartment portion is configured to hold a container of wipes, and the lower compartment is configured to have a bottom dispensing sanitizer dispensing apparatus mounted therein; and said front door including a recessed area through which any sanitizer dispensing apparatus mounted in the lower compartment may be accessed.

7. The dual compartment mountable sanitation station of claim 6, wherein said lower compartment portion includes an integrated latching lip and the front door includes a lower cam lock, said lower cam lock and latching positioned so that when the upper cam lock is actuated with the front door in the closed position, it engages the latching lip to form an interlock that locks the front door in the closed position against the lower compartment portion.

8. The dual compartment mountable sanitation station of claim 6, wherein the removable top includes a latching member and the upper compartment portion includes an integrated upper cam lock, said upper cam lock and latching member positioned such that when the upper cam lock is actuated with the removable top in place on the upper compartment portion, it engages the latching member and forms an interlock that locks the removable top in place on the upper compartment portion.

9. The dual compartment mountable sanitation station of claim 6, wherein said lower compartment portion and the front door include a lower means for selectively locking the enclosure formed by the front door on the lower compartment portion.

10. The dual compartment mountable sanitation station of claim 6, additionally comprising a container access lid configured to hold a wipes container and be suspended from the dispensing aperture.

11. The dual compartment mountable sanitation station of claim 10, wherein the container access lid is defined by a rigid top section and an attachment section, wherein the top section includes a dispensing tip sized to fit through the dispensing aperture and threaded bottom and the attachment section includes a rigid threaded area and an elastic holding area, said threaded area for attaching to the threaded bottom and the holding area for being stretched over the rim of any wipes container such that the container is held sufficient to resist inadvertently sliding out of the holding area.

12. The dual compartment mountable sanitation station of claim 11, wherein the dispensing aperture includes at least one retaining flap adapted to hold the dispensing tip in place sufficient to resist inadvertent movement once it has been inserted through the dispensing aperture.

13. A dual compartment mountable sanitation station for mounting in a public bathroom stall, comprising:

an upper compartment portion having a removable top, wherein said removable top includes a dispensing aperture;

a lower compartment portion having a front door hingedly attached to the side of the lower compartment portion such that it is movable between an open position and a closed position, wherein the upper compartment portion and lower compartment portion are arranged in a stacked orientation, the upper compartment portion is configured to hold a container of wipes, and the lower compartment is configured to have a bottom dispensing sanitizer dispensing apparatus mounted therein;

a container access lid configured to hold a wipes container and be suspended from the dispensing aperture, wherein said container access lid is defined by a rigid top section and an attachment section, wherein the top section includes a dispensing tip sized to fit through the dispensing aperture and threaded bottom and the attachment section includes a rigid threaded area and an elastic holding area, said threaded area for attaching to the threaded bottom and the holding area for being stretched over the rim of any wipes container such that the container is held sufficient to resist inadvertently sliding out of the holding area;

said front door including a recessed area through which any sanitizer dispensing apparatus mounted in the lower compartment may be accessed;

wherein the removable top and the upper compartment portion include an upper means for selectively locking the enclosure formed by the removable top on the upper compartment portion so access to such a canister can be restricted; and wherein said lower compartment portion and the front door include a lower means for selectively locking the enclosure formed by the front door on the lower compartment portion.

14. A dual compartment mountable sanitation station for mounting in a public bathroom stall, comprising:

an upper compartment portion having a removable top, wherein said removable top includes a dispensing aperture;

a lower compartment portion having a front door hingedly attached to the side of the lower compartment portion such that it is movable between an open position and a closed position, wherein the upper compartment portion and lower compartment portion are arranged in a stacked orientation, the upper compartment portion is configured to hold a container of wipes, and the lower compartment is configured to have a bottom dispensing sanitizer dispensing apparatus mounted therein;

said lower compartment portion and the front door including a lower means for selectively locking the enclosure formed by the front door on the lower compartment portion; and said front door including a recessed area through which any sanitizer dispensing apparatus mounted in the lower compartment may be accessed.

15. The dual compartment mountable sanitation station of claim 14, wherein said lower compartment portion includes an integrated latching lip and the front door includes a lower cam lock, said lower cam lock and latching positioned so that when the upper cam lock is actuated with the front door in the closed position, it engages the latching lip to form an interlock that locks the front door in the closed position against the lower compartment portion.

16. The dual compartment mountable sanitation station of claim 14, wherein the removable top includes a latching member and the upper compartment portion includes an integrated upper cam lock, said upper cam lock and latching member positioned such that when the upper cam lock is actuated with the removable top in place on the upper compartment portion, it engages the latching member and forms an interlock that locks the removable top in place on the upper compartment portion.

17. The dual compartment mountable sanitation station of claim 14, wherein the removable top and the upper compartment portion include an upper means for selectively locking the enclosure formed by the removable top on the upper compartment portion so access to such a canister can be restricted.

18. The dual compartment mountable sanitation station of claim 14, additionally comprising a container access lid configured to hold a wipes container and be suspended from the dispensing aperture.

19. The dual compartment mountable sanitation station of claim 18, wherein the container access lid is defined by a rigid top section and an attachment section, wherein the top section includes a dispensing tip sized to fit through the dispensing aperture and threaded bottom and the attachment section includes a rigid threaded area and an elastic holding area, said threaded area for attaching to the threaded bottom and the holding area for being stretched over the rim of any wipes container such that the container is held sufficient to resist inadvertently sliding out of the holding area.

20. The dual compartment mountable sanitation station of claim 19, wherein the dispensing aperture includes at least one retaining flap adapted to hold the dispensing tip in place sufficient to resist inadvertent movement once it has been inserted through the dispensing aperture.

* * * * *